US009364853B2

(12) United States Patent
Chen

(10) Patent No.: US 9,364,853 B2
(45) Date of Patent: Jun. 14, 2016

(54) METHODS FOR COVALENTLY ATTACHING MOLECULES ON SURFACES AND PRODUCING NON-FOULING SURFACES

(76) Inventor: Xiaoxi Kevin Chen, Natick, MA (US)

( * ) Notice: Subject to any disclaimer, the term of this patent is extended or adjusted under 35 U.S.C. 154(b) by 126 days.

(21) Appl. No.: 13/403,967

(22) Filed: Feb. 23, 2012

(65) Prior Publication Data

US 2012/0219697 A1 Aug. 30, 2012

Related U.S. Application Data

(60) Provisional application No. 61/447,043, filed on Feb. 26, 2011.

(51) Int. Cl.
*B05D 1/00* (2006.01)
*B05D 5/08* (2006.01)

(52) U.S. Cl.
CPC ... *B05D 1/62* (2013.01); *B05D 5/08* (2013.01)

(58) Field of Classification Search
USPC ..... 523/107
See application file for complete search history.

(56) References Cited

U.S. PATENT DOCUMENTS 7,521,488 B2 * 4/2009 Steffen et al. ..... 523/107
2006/0067981 A1 * 3/2006 Xia ..... 424/428

OTHER PUBLICATIONS

Mar et al., An intrinsically protein-resistant surface plasmon resonance biosensor based upon a RF-plasma-deposited thin film, 1999, Sensors and Actuators, vol. B Issue 54, pp. 125-131.*

* cited by examiner

*Primary Examiner* — Dah-Wei D Yuan
*Assistant Examiner* — Andrew Bowman

(57) ABSTRACT

The present invention relates to methods of modifying the chemical structure of a surface by covalently attaching molecules containing desired functional groups on the surface using plasma energy. In these methods, chemical compounds containing the desired functional groups and having a vapor pressure lower than 0.001 bar are exposed in the plasma chamber together with the substrate. Surface area of the chemical compound is optimized to generate adequate evaporation rate. The modification of the substrate surface is achieved in a plasma state generated from the vapor of the chemical compounds; while the evaporation of the chemical compounds is accelerated by the plasma energy. Methods for producing non-fouling surface by covalently attaching ethylene glycol oligomers on the surface are disclosed.

4 Claims, 4 Drawing Sheets

METHODS FOR COVALENTLY ATTACHING MOLECULES ON SURFACES AND PRODUCING NON-FOULING SURFACES

CROSS-REFERENCE TO RELATED APPLICATION

This application claims priority of U.S. Provisional Patent Application No. 61/447,043, filed Feb. 26, 2011, the entire contents of which are incorporated by reference herein.

FIELD OF THE INVENTION

The present invention relates to methods of modifying the chemical structure of a surface by covalently attaching molecules containing desired functional groups on the surface using plasma energy. In these methods, chemical compounds containing the desired functional groups and having a vapor pressure lower than 0.001 bar are exposed in the plasma chamber together with the substrate. Surface area of the chemical compound is optimized to generate adequate evaporation rate. The modification of the substrate surface is achieved in a plasma state generated from the vapor of the chemical compounds; while the evaporation of the chemical compounds is accelerated by the plasma energy. Methods for producing non-fouling surface by covalently attaching ethylene glycol oligomers on the surface are disclosed.

BACKGROUND OF THE INVENTION

Surface modification is used to obtain desired surface properties, such as non-fouling properties. Modification of surfaces by plasma energy, including plasma treatment and plasma polymerization, has been described in prior arts. For example, in U.S. Pat. No. 6,482,531, plasma polymerization methods are described in which a pulsed plasma discharge is used to polymerize a monomer. In U.S. Pat. No. 5,002,794 and U.S. Pat. No. 5,153,072, plasma polymerization methods involving controlling the temperature of the substrate and the reactor so as to create a temperature differentially between the substrate and reactor are disclosed.

In the prior arts of plasma polymerization, the monomer is introduced to the plasma chamber through an inlet with valve(s) and/or flow regulator(s). The valve or flow regulator is first closed, and the plasma chamber is pumped down to sufficiently high vacuum with the monomer being separated by the valve/flow regulator from the chamber. Then the valve or flow regulator is opened to allow the vapor of the monomer to enter the vacuum chamber. After the pressure of the monomer in the chamber stabilizes, the plasma power is turned on to generate plasma in the chamber. The plasma in the chamber induces the deposition and polymerization of the monomer on surfaces exposed in the plasma chamber.

One limitation of the prior arts is that it does not work well if the vapor pressure of the monomer at room temperature is relatively low. Therefore, monomers used in plasma polymerization have been limited to compounds with relatively high vapor pressure, such as allyl alcohol, allylamine, acrylic acid and octadiene.

One way to overcome this limitation is to use elevated temperature to improve the flow of low-vapor-pressure monomers to the chamber. However, it requires extra equipment to maintain the whole plasma chamber at an elevated temperature, and the partial pressure of the monomer in the chamber is still limited by the conductance of the monomer inlet system, including the pipes and valves and/or flow regulators.

Reducing vacuum pumping rate may increase the partial pressure of the monomer, but it also increases the impurity (especially oxygen) in the plasma. Due to insufficient monomer vapor pressure and/or high impurity of the chemical vapor in the chamber, the efficiency of surface coating is low, resulting in low density of the desired functional groups coated on the surface.

In the case of producing a non-fouling surface by covalently attaching ethylene glycol groups, insufficient coating density results in ineffective functions due to pin holes that provide binding sites. The surfaces produced this way may not be able to reduce the binding of macromolecules or micro-organisms compared to the untreated surface; or it may reduce the binding but not to the desired level.

SUMMARY OF THE INVENTION

A method is disclosed herein for covalently attaching molecules with desired functional groups on surfaces in a plasma chamber using chemical compounds with relatively low vapor pressure. In this inventive method, the chemical compound, which has a vapor pressure lower than 0.001 bar, is placed inside the plasma chamber, and the surface area of chemical compound is optimized to generate adequate evaporation rate during the process. The amount of chemical compounds is sufficient to maintain the vapor pressure during the process.

An unexpected advantage of placing the chemical compound in the plasma chamber is that the evaporation rate of the chemical compound is further increased after the plasma is turned on, as the molecules in the vapor are ionized by the plasma and the temperature increases due to plasma energy. The increase of evaporation rate and vapor pressure improve the plasma modification as there are more ions generated from the chemical are available for reacting with the surface. This is especially beneficial when chemicals which have relatively low vapor pressure are used.

These and other features of the invention will be better understood through a study of the following detailed description and accompanying drawings.

DETAILED DESCRIPTION OF THE INVENTION

Figure 1:
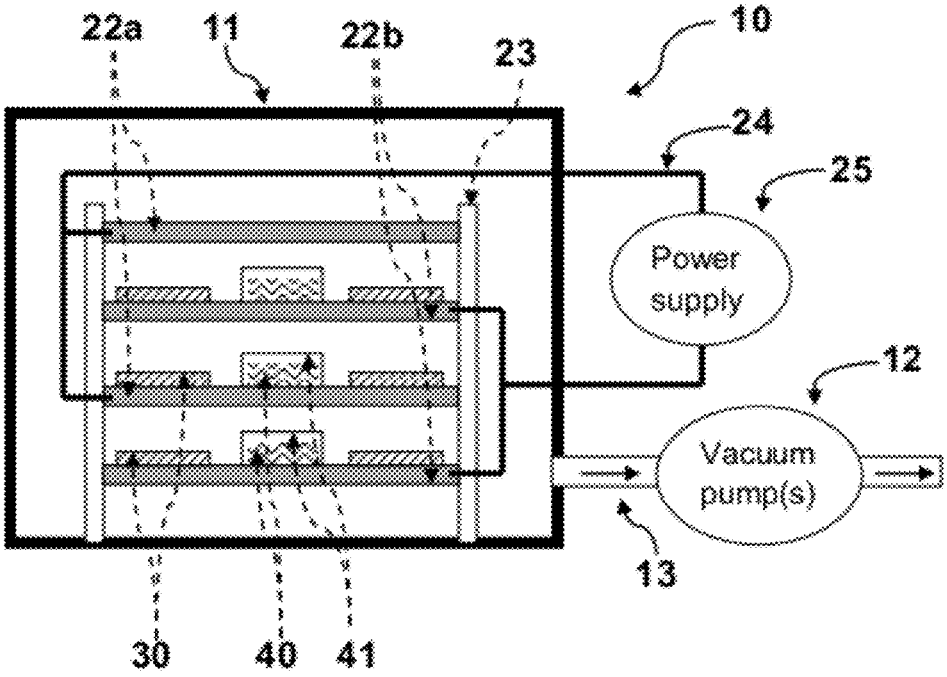
FIG. 1 is a drawing representing a method in accordance with the subject invention, where a capacitively coupled plasma system is utilized for surface modification.
Figure 2:
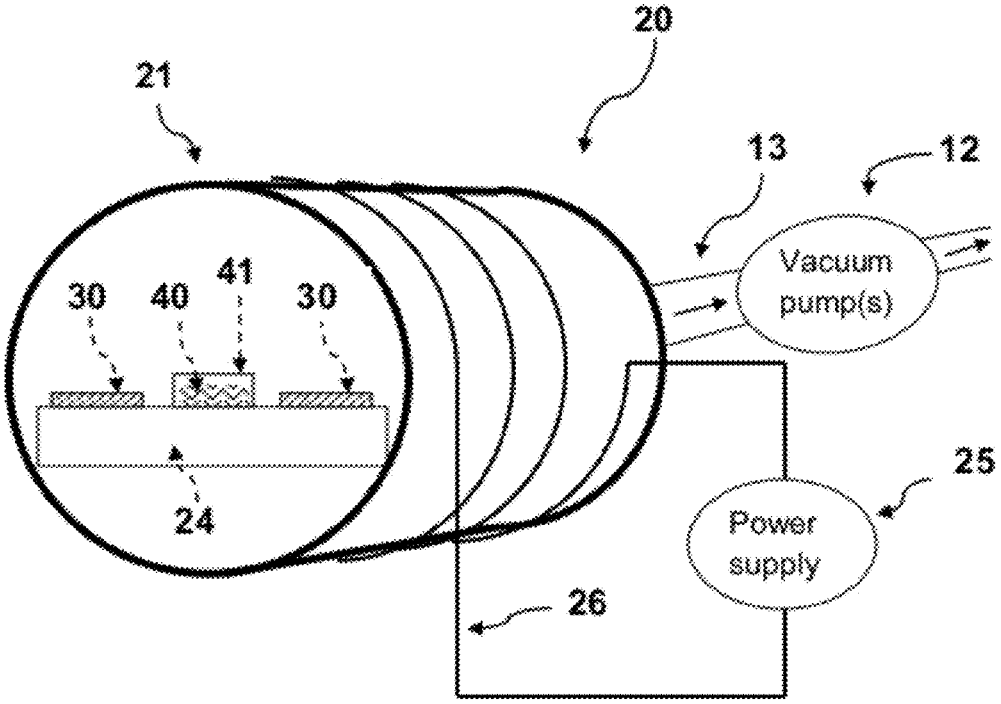
FIG. 2 is a drawing representing a method in accordance with the subject invention, where an inductively coupled plasma system is utilized for surface modification.

With reference to FIG. 1, a method 10 is depicted of modifying the surface of substrate 30 using chemical compound 40 in a plasma chamber 11 equipped with a capacitatively coupled plasma system. With reference to FIG. 2, a method 20 is depicted of modifying the surface of substrate 30 using chemical compound 40 in a plasma chamber 21 equipped with a inductively coupled plasma system.

With reference to both FIG. 1 and FIG. 2, a vacuum chamber 11 (FIG. 1) or 21 (FIG. 2) is connected to a pump 12 through connector 13. Sometimes, more than one pump is used to produce a sufficiently high vacuum. For example, one pump can be used to create a roughing vacuum around one torr, and a second pump (such as a turbo-molecular pump) can be used to create a higher vacuum below 0.1 torr.

Any known technique can be used to generate plasma in the chamber. The plasma may be generated using AC or DC power, radio-frequency (RF) power or micro-wave frequency power. Preferably, the plasma system is driven by a single radio-frequency (RF) power supply; typically at 13.56 MHz. The plasma system can either be capacitively coupled plasma, as shown in FIG. 1, or inductively coupled plasma, as shown in FIG. 2.

In the case of capacitively coupled plasma, as exemplified in FIG. 1, there are one or more electrodes in the chamber, and the chamber wall itself can be a grounded electrode. In the example shown in FIG. 1, a set of metal plates 22 are supported and maintained a fixed distance from each other by an insulating scaffold 23. The metal plates are divided into two subsets 22*a* and 22*b*, which form an alternating pattern. Metal plates 22*a* are connected electrically to each other and metal plates 22*b* are electrically connected to each other. These two sets of metal plates are connected to a radio-frequency (RF) power source 25 outside of the vacuum chamber via wires or cables 24. The number of metal plates can vary from one to as many as the vacuum chamber can hold, and they can function as electrodes for generating capacitively coupled plasma. Plasma can form in the space between the metal plates and around the metal plates.

In the case of inductively coupled plasma, as exemplified in FIG. 2, the wall of the chamber 21 is made of an insulating material, and the electric current in the wires 26, which coil around the outside of the chamber wall, generates plasma in the chamber through electromagnetic induction.

Substrate 30 can be positioned anywhere in the vacuum chamber, as long as the surface to be modified will be exposed to the plasma. In the example shown in FIG. 1, the substrates 30 are placed on the metal plates 22. In the example shown in FIG. 2, the substrates 30 are placed on a scaffold 24. The substrates can also be placed on the bottom of the chamber. The substrate can be positioned horizontally as shown in FIG. 1 and FIG. 2, or held vertically or with a tilting angle. There are advantages of having the substrate held vertically in some cases, for example when both sides of the substrate need to be treated.

The substrate may be made of any materials, including polymers, glass, metal and silicon. Examples of polymers include polystyrene, polypropylene, polyethylene, polyester, silicone, ABS, PVC, polytetrafluoroethylene, polyvinylidene, and mixtures thereof. In one example, the substrates are micro-slides made of glass, used in biological assay applications. In another example, the substrates are multiwall plates, made of polystyrene or polypropylene, used in biological assay applications or drug assay handling equipment (e.g., high throughput screening (HTS) equipment). In another example, the substrates are urinary catheters, made of silicone material. In another example, the substrates are contact lenses, made of silicone hydrogel material. In another example, the substrates are the exterior or interior of electronic devices such as cell phones. In another example, the substrates are polyester films or silicone covers used to protect electronic devices such as cell phone.

The chemical compound 40, which is usually a liquid and placed in a container 41, can be positioned anywhere in the vacuum chamber. The chemical compound can also be spread on the surface of a scaffold to increase the evaporation area. In the example shown in FIG. 1, the chemical compound 40 and container 41 are placed on the metal plates 22. In the example shown in FIG. 2, the chemical compound 40 and container 41 are placed on the scaffold 24.

The chemical compound is typically a liquid with vapor pressure lower than 0.001 bar, and it contains the functional groups to be covalently attached on the surface. The chemical compound can also be a solid or gel. In the case when the chemical compound is a liquid, the container is chosen to ensure an appropriate amount of surface area is exposed in the vacuum chamber, so that the evaporation rate, which is proportional to the surface area, is adequate. For producing non-fouling surfaces, the chemical compound is preferably Tri (ethylene glycol) monoethyl ether ($CH_3CH_2(OCH_2CH_2)_3OH$) or Tri(ethylene glycol) monomethyl ether ($CH_3(OCH_2CH_2)_3OH$).

In the first step of the process, the vacuum chamber is pumped down to sufficiently low pressure with the substrate 30 and chemical compound 40 both present in the vacuum chamber. This can be achieved, for example, first by using a roughing pump to create a vacuum of below 1 torr, and then by using a turbomolecular pump or a diffusion pump to create a higher vacuum. The ultimate level of vacuum is dependent on the vapor pressure and surface area of the liquid chemical in the vacuum chamber. Care is taken not to allow the chemical compound to dry out completely before the plasma is turned off.

In the second step of the process, once a desired vacuum level is reached, the plasma power source 25 is turned on to create plasma. A tuning unit (not shown in the figures), which is composed of circuits containing adjustable capacitors and inductance, is sometimes used to initiate and maintain the plasma. The tuning unit is used to improve the efficiency of the power transfer from the RF generator to the plasma system by matching the impedance of the plasma system. The plasma is maintained for a period of time to allow the surface of the substrates to be modified. The pressure of the chamber increases usually as the plasma is turned on. The presence of the plasma in the chamber also accelerates the evaporation of the chemical compound due to the ionization of the molecules near the surface of the compound and the increase of temperature when the plasma is present. The increase of evaporation rate and vapor pressure improve the plasma modification as there are more ions generated from the chemical are available for reacting with the surface. This is especially beneficial when chemicals which have relatively low vapor pressure are used. The power level of the RF generator is adjusted in the range where it is high enough to maintain the plasma in the areas around the substrate, but not too high to induce too much fragmentation/atomization of the molecules in the plasma. The suitable power level is dependent on the properties of the chemical and the properties of the substrate, including the material type of the substrate and the geometrical structure of the substrate.

In the final step of the process, the plasma is turned off, and the vacuum chamber is evacuated to allow the substrates 30 to be retrieved.

In a preferred embodiment to produce a non-fouling surface, the chemical compounds used have a formula $CH_3(CH_2)_m(OCH_2CH_2)_nOH$, where $m \geq 0$ and $n \geq 3$, such as Tri (ethylene glycol) monoethyl ether ($CH_3CH_2(OCH_2CH_2)_3OH$) or Tri(ethylene glycol) monomethyl ether ($CH_3(OCH_2CH_2)_3OH$). Chemical compounds with similar molecular structure, specifically those containing saturated hydrocarbons on one end and ethylene glycol oligomers on the other end, can also be used. In the plasma state, the saturated hydrocarbons are ionized and can react with the surface of the substrate, forming a covalently bound thin film containing ethylene glycol oligomers. The substrates coated with this thin film of ethylene glycol oligomers obtain the ability to resist the binding/attachment of macromolecules and micro-organisms. The treated surfaces become non-fouling and anti-microbial due to the ability to resist binding/attachment of macromolecules and micro-organisms. The substrates treated can be, but not limited to be, made of polymers, glass, metal and metal oxide. The polymers can be, but not limited to be, polystyrene, polypropylene, polyester, polycarbonate, silicone, and mixed polymers.

EXAMPLES

Example A

Figure 3:
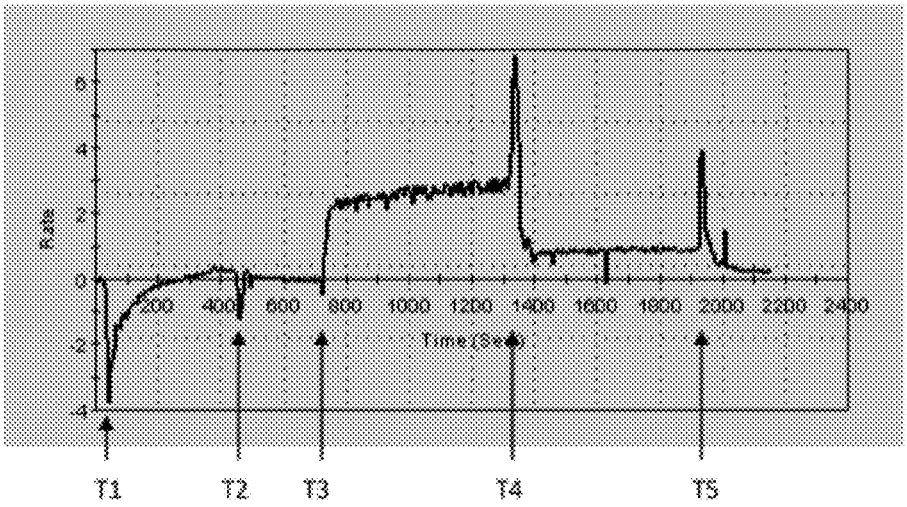
FIG. 3 is a plot showing the thin film thickness growing rate versus time during the vacuum pump down and plasma modification process.

A plasma chamber is set up according to FIG. 1, wherein the chemical 40 is Tri(ethylene glycol) monoethyl ether ($CH_3CH_2(OCH_2CH_2)_3OH$), the container 41 is a Petri dish, and the substrate 30 is a quartz crystal micro-balance (QCM). The QCM is connected to an electronic device outside of the chamber through a coaxial cable. The electronic device records the thickness increasing rate of the thin film deposited on the QCM and the recorded data are fed into a computer. A plot of the thin film thickness increasing rate versus time is shown in FIG. 3. The unit of rate is angstrom/second, or 0.1 nm/s. At time T1, the chamber is started to be pumped down using a roughing pump to create a vacuum in the chamber; the deposition rate first turned negative as some residual molecules absorbed on the QCM surface evaporated. At time T2, the chamber is started to be pumped down using a turbo-molecular pump to create a higher vacuum. At time T3, a plasma is generated in the chamber using an RF power supply with power level adjusted to 100 W. The plasma contains ions generated from the chemical vapor. These ions react with the QCM surface to form a thin film on the surface. The thickness growth rate of the thin film recorded by the QCM was around 2.5 angstrom/second. At time T4, the power level was adjusted to 10 W, and the thickness growth rate decreased to 0.8 angstrom/second. At time T5, the plasma was turned off. The accumulated film thickness was 1600 angstrom, or 160 nm.

Example B

Figure 4:
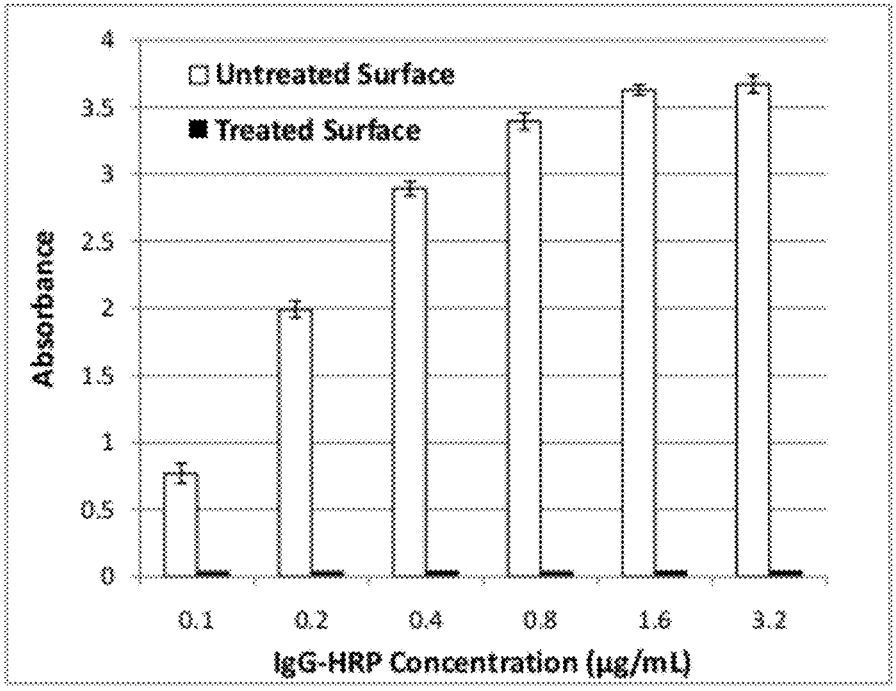
FIG. 4 is a chart comparing the non-specific binding of Immunoglobin G-horseradish peroxide conjugate (IgG-HRP) on two different surfaces: one surface is untreated and the other surface was treated by the subject invention. The amount of IgG-HRP conjugate was quantified by the HRP catalyzed oxidation of TMB (3,3',5,5' tetramethylbenzidine), which changes color upon oxidation.

A plasma chamber is set up according to FIG. 1, wherein the chemical 40 is Tri(ethylene glycol) monoethyl ether ($CH_3CH_2(OCH_2CH_2)_3OH$), the container 41 is a Petri dish, and the substrate 30 are 96-well plates made of polystyrene material. The chamber is pumped down first by a roughing pump and then by a turbo-molecular pump to create a vacuum. Then a plasma is generated in the chamber using an RF power supply with power level adjusted to 20 W. The plasma contains ions generated from the vapor of Tri(ethylene glycol) monoethyl ether. These ions react with the surfaces of the 96-well plate to form a thin film consisting of ethylene glycol oligomers on the surface. The plasma is maintained for 30 minutes to allow for the formation of a pin-hole free thin film on the polystyrene surface. The treated 96-well plate was then compared to an untreated 96-well plate for their ability to resist the binding of macromolecules. The surfaces in the wells of both of the plates were brought into contact with mouse IgG-HRP (Immunoglobin G-horseradish peroxide conjugate) for 2 hours followed by washing with PBS (phosphate buffered saline). Thereafter, the surfaces were brought into contact with TMB (3,3',5,5' tetramethylbenzidne) solution for 10 minutes followed by adding 1N HCl to stop the reaction. The amount of IgG-HRP bound on the surfaces was quantified by the intensity of the color (detected at 450 nm) produced by the oxidized TMB. As can been seen in FIG. 4, as the concentration of IgG-HRP increased, more IgG-HRP were absorbed by the untreated surface, and the absorbance increases until reaching plateau. In contrast, there was no observable absorbance on the treated surface, even at the highest IgG-HRP concentration tested.

As will be appreciated by those skilled in the art, the subject invention provides functionalized surfaces for a variety of applications, especially those in the medical and biological fields. By way of non-limiting examples, the subject invention can be used to prepare surfaces to resist binding of macromolecules and micro-organism, and subsequently become non-fouling. Non-fouling surfaces obtained by the subject invention can be used to prevent biofilm formation in medical devices and medical implants, such as contact lenses, central venous catheters and needleless connectors, endotracheal tubes, intrauterine devices, mechanical heart valves, pacemakers, peritoneal dialysis catheters, prosthetic joints, tympanostomy tubes, urinary catheters, and voice prostheses. Non-fouling surfaces obtained by the subject invention can also be used to prevent protein binding to the surfaces of the container in protein assays, and prevent cell attachment in suspension cell culture. In particular, the non-fouling surface obtained by the subject invention can be used to prevent stem cells from attachment-mediated differentiation in embryoid body formation and culture. Non-fouling surfaces obtained by the subject invention can also be used to provide antibacterial protection for portable electronic devices such as cell phones, laptop computers and tablet computers. The subject invention can be used to provide an antibacterial coating on the surfaces of portable electronic devices, or on the surfaces of the protective covers/films used for portable electronic devices.

What is claimed is:

1. A method for modifying the surface of an object to make it a non-fouling surface comprising:

a) disposing said object in a vacuum chamber, with the surface to be treated b) disposing chemical compounds including Tri(ethylene glycol) monoethyl ether ($CH_3CH_2(OCH_2CH_2)_3OH$) and/or Tri(ethylene glycol) monomethyl ether ($CH_3(OCH_2CH_2)_3OH$) in said vacuum chamber, wherein some surface of each said chemical compound is exposed so that the surface molecules can evaporate into said vacuum chamber;

c) creating a vacuum in said vacuum chamber using one or more vacuum pumps;

d) creating a plasma in said vacuum chamber; said plasma contains ions generated from the vapor of said chemical compound(s); and e) allowing the surface of said object to react with said plasma for some period of time.

2. The method of claim 1, wherein said object is a medical device.

3. The method of claim 1, wherein said object is a medical device and the surface modification is used to prevent the formation of biofilm when the device is used in human or animal body.

4. The method of claim 1, wherein said object is selected from the following: contact lenses, central venous catheters and needleless connectors, endotracheal tubes, intrauterine devices, mechanical heart valves, pacemakers, peritoneal dialysis catheters, prosthetic joints, tympanostomy tubes, urinary catheters, and voice prostheses.

* * * * *